US007655935B1

(12) United States Patent
Frank

(10) Patent No.: US 7,655,935 B1
(45) Date of Patent: Feb. 2, 2010

(54) PLUTONIUM RADIATION SURROGATE

(75) Inventor: Michael I. Frank, Dublin, CA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 264 days.

(21) Appl. No.: 11/748,689

(22) Filed: May 15, 2007

(51) Int. Cl.
*G21G 4/00* (2006.01)

(52) U.S. Cl. ..... 250/493.1; 250/252.1; 252/625

(58) Field of Classification Search ..... 250/252.1, 250/493.1; 252/652
See application file for complete search history.

(56) References Cited

U.S. PATENT DOCUMENTS 3,161,504 A * 12/1964 Black et al. ..... 419/6
3,663,177 A * 5/1972 Arino et al. ..... 250/432 PD
7,183,554 B2 2/2007 Gallagher et al.
2004/0075048 A1 * 4/2004 Zyromski ..... 250/252.1
2007/0023665 A1 2/2007 Gallagher et al.

* cited by examiner

*Primary Examiner*—David P Porta
*Assistant Examiner*—Marcus H Taningco
(74) *Attorney, Agent, or Firm*—Fred A. Lewis; James C. Durkis; Paul A. Gottlieb

(57) ABSTRACT

A self-contained source of gamma-ray and neutron radiation suitable for use as a radiation surrogate for weapons-grade plutonium is described. The source generates a radiation spectrum similar to that of weapons-grade plutonium at 5% energy resolution between 59 and 2614 keV, but contains no special nuclear material and emits little α-particle radiation. The weapons-grade plutonium radiation surrogate also emits neutrons having fluxes commensurate with the gamma-radiation intensities employed.

15 Claims, 4 Drawing Sheets

PLUTONIUM RADIATION SURROGATE

STATEMENT OF FEDERAL RIGHTS

The United States Government has rights in this invention pursuant to Contract No. W-7405-ENG-48, between the United States Department of Energy and the University of California for the operation of the Lawrence Livermore National Laboratory.

FIELD OF THE INVENTION

The embodiments of the present invention relates generally to radioisotopic sources and, more particularly, to a source of gamma rays and neutrons for providing a radiation spectrum similar to that of weapons-grade plutonium without the use of special nuclear material.

BACKGROUND OF THE INVENTION

Radiation detection technology is being deployed worldwide to address concerns regarding the illicit movement of radiological and nuclear materials. Equipment of different types and from various manufacturers is being distributed to operators with varying levels of training and different backgrounds. There is a need to reliably exercise and demonstrate the capabilities of these detectors and responders. In particular: (1) many detector developers, manufacturers, and vendors do not have weapons-grade plutonium, WGPu, for testing their hardware or isotope identification algorithms; (2) since the identification of shielded or masked plutonium depends on the plutonium radiation intensity and spectrum, a high-fidelity surrogate exhibiting the full WGPu spectrum is needed to test the effects of shielding and masking in different shielding configurations; (3) fixed-site radiation detection equipment (ports, border crossings, etc.) requires in situ testing capability, and (4) nuclear incident response exercises require credible materials.

The use of Nuclear Explosive-Like Assemblies (NELAs) is not always an attractive option for the stated applications, since NELAs typically contain actual SNM combined with inert materials (or conversely, high-explosives combined with non-radioactive materials), and their use is limited to secure facilities. The use of a NELA is prohibitive due to cost, safety and security concerns for all but the most pressing needs. By contrast, a non-SNM surrogate can be transported and deployed without the substantive administrative controls required for SNM.

Accordingly, it is an object of the embodiments of the present invention to provide a radiation surrogate having a neutron and gamma-ray signature which is representative of the neutron and gamma-ray spectrum of weapons-grade plutonium at an energy resolution of 5% without the use of special nuclear material.

Another object of the embodiments of the present invention is to provide a radiation surrogate having a neutron and gamma-ray signature which is representative of the gamma-ray spectrum of weapons-grade plutonium at an energy resolution 5% over an energy range of 59 keV to 2614 keV without the use of special nuclear material.

Still another object of the embodiments of the present invention is to provide a radiation surrogate having a neutron and gamma-ray signature which is representative of the gamma-ray spectrum of weapons-grade plutonium at an energy resolution 5% over an energy range of 59 keV to 2614 keV without the use of special nuclear material, and having low α-particle emission.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the radiation surrogate for weapons-grade plutonium, includes in combination: the radioisotopes Ba-133 having all activity of between about 5 and about 5.5 μCi, Cf-252 having an activity of between about 4 and about 5 μCi, Cs-137 having an activity of between about 10.2 and about 10.4 μCi, Gd-153 having an activity of between about 350 and about 550 μCi, Lu-177 m having an activity between about 40 and about 50 μCi, Sn-113 having an activity between about 13.5 and about 30 μCi, and Zr-95 having an activity between about 1 and about 6 μCi.

The embodiments of the present invention overcome the disadvantages and limitations of the prior art, and benefits and advantages thereof include, but are not limited to, providing a neutron and gamma ray source that represents the gamma-ray spectrum of weapons-grade plutonium at 5% energy resolution between 59 keV and 2614 keV without containing special nuclear material and α-particle emitters, and in a form which is easier to deploy than nuclear explosive-like assemblies or small quantities of plutonium while meeting Department of Transportation Limited Quantity requirements. The embodiments of the invention do not require replacement of radioisotopes more frequently than about three-month intervals.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings:

FIG. 1A is a schematic representation of an embodiment of the present invention showing a cylindrical vessel containing radioisotope wafer sources, and a spherical source holder having a concave bolt-on base and adapted to receive the cylindrical vessel, while

DETAILED DESCRIPTION OF THE INVENTION

Briefly, embodiments of the present invention includes an apparatus for providing a neutron and gamma-ray source that represents the gamma-ray spectrum of weapons-grade plutonium at 5% energy resolution between 59 keV and 2614 keV without containing special nuclear material and without significant α-particle emission, and which meets Department of Transportation Limited Quantity requirements, while reliably yielding plutonium isotope identification by current and next-generation identification equipment and algorithms.

Figure 1A:
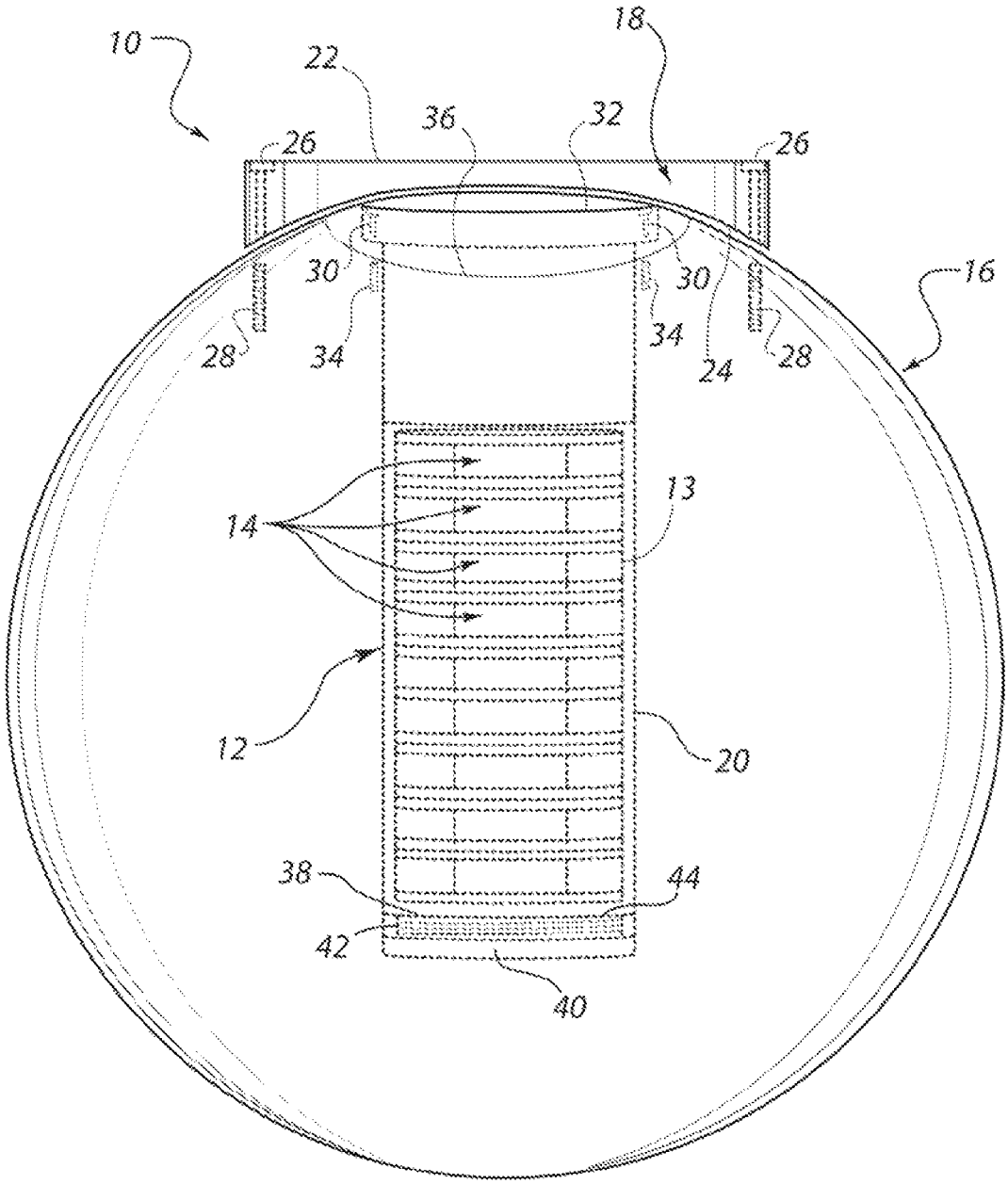

Reference will now be made in detail to the present embodiments of the inventions, examples of which are illustrated in the accompanying drawings. In the FIGURES, similar structure will be identified using identical callouts. Turning now to FIG. 1A, illustrated is a schematic representation of an embodiment of the surrogate plutonium radiation source of the present invention, 10, showing cylindrical vessel, 12, having a bore, 13, containing radioactive disk sources, 14, and spherical source holder, 16, having base, 18, into which cylindrical vessel 12 is disposed.

Figure 1B:
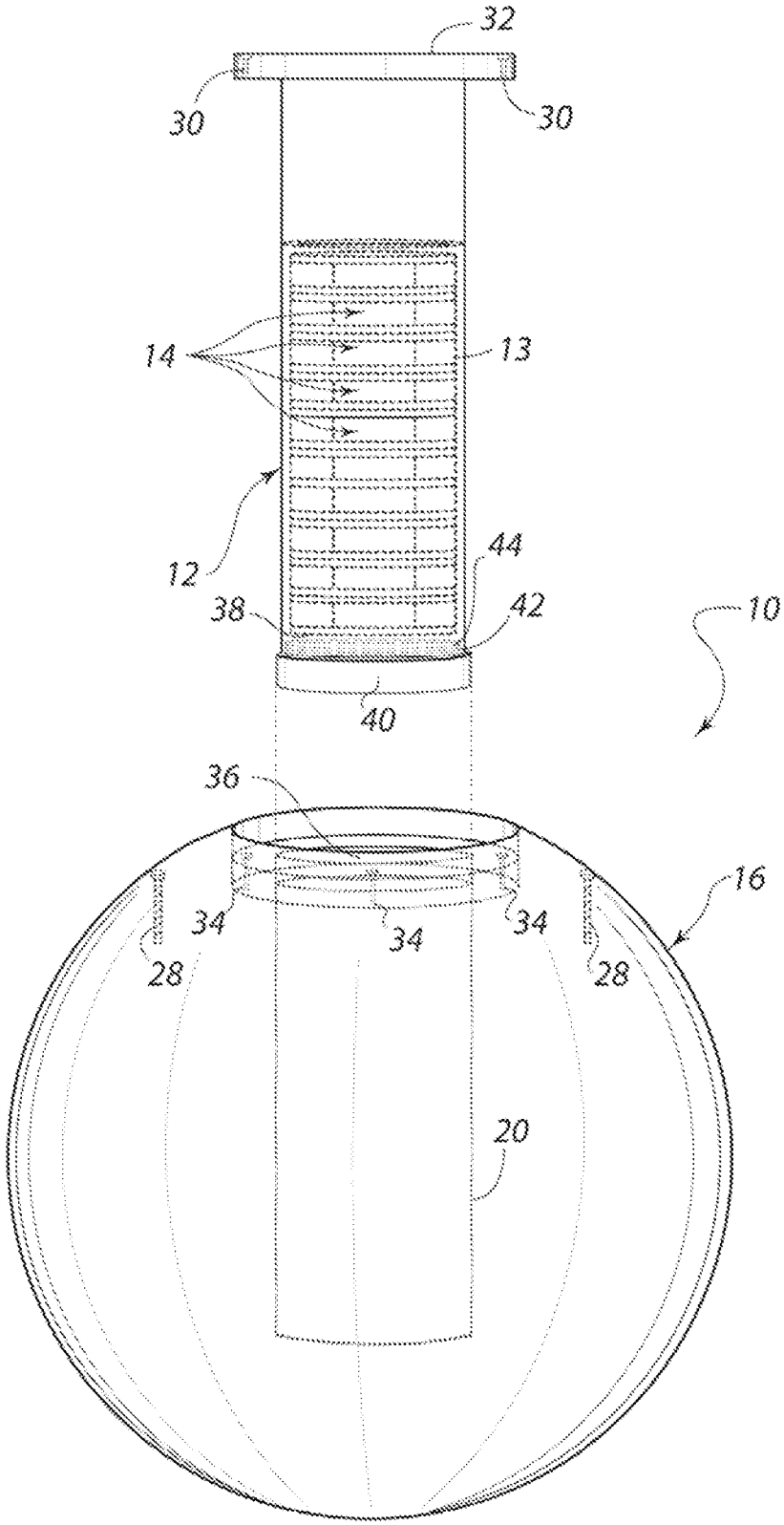
FIG. 1B is a schematic representation of the embodiment of the present invention shown in FIG. 1A showing the cylindrical vessel removed from the spherical source holder.

FIG. 1B is a schematic representation of the embodiment of the present invention illustrated in FIG. 1A hereof showing cylindrical vessel 12 removed from spherical source holder 16. Spherical source holder 16 has a cylindrical passage, 20, therein adapted to receive cylindrical vessel 12. Base 18 has flat surface, 22, concave surface, 24, and counterbored or countersunk holes, 26, which align with threaded holes, 28, in spherical holder 16 such that base 18 can be secured thereto by the use of screws (not shown in FIG. 1A and FIG. 1B). After cylindrical vessel 12 is disposed inside of and secured to spherical holder 16 using screws (not shown in FIG. 1A and FIG. 1B), inserted through counterbored holes, 30, in flange portion, 32, and into matching threaded screw holes, 34, in flat portion, 36, adapted to receive said screws, and base 18 is attached thereto, the plutonium surrogate 10 may be rotated by 180° for deployment such that flat surface 22 of base 18 may be placed on a flat surface. Use of cylindrical vessel 12 permits radioisotope sources 14 to be replaced when the half-lives of the radioisotopes employed no longer permit acceptable activities to be obtained therefrom.

Figure 2:
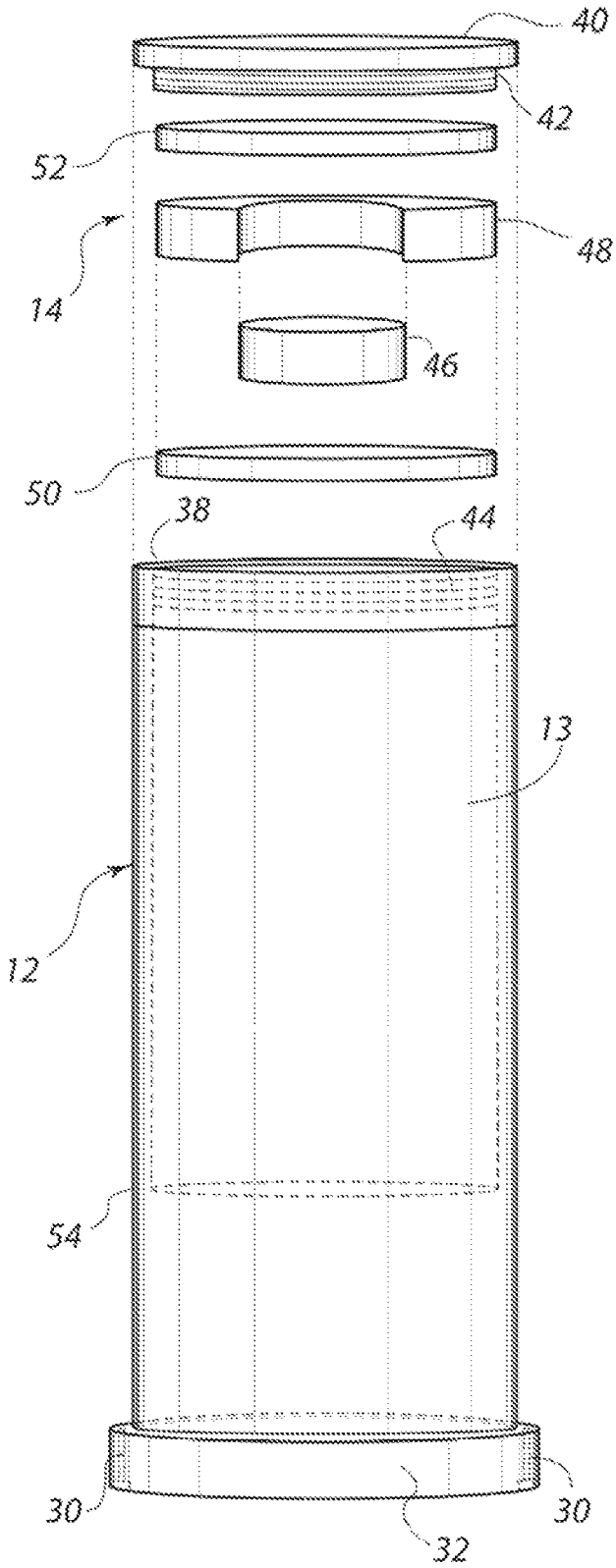
FIG. 2 is a schematic representation of the cylindrical vessel shown in FIGS. 1A and 1B illustrating one of the radioisotope wafer sources removed and disassembled.

FIG. 2 shows a schematic representation of cylindrical vessel 12 illustrated in FIGS. 1A and 1B with one of radioactive wafer sources 14 removed and disassembled. Open end, 38, of cylindrical vessel 12, is closed, after radioactive sources 14 are placed therein, using screw cap, 40, having threaded portion, 42, which screws into matching threaded portion 44 of vessel 12. Wafer sources 14 include cylindrical radioactive disk, 46, which is disposed in the inner opening of washer, 48, for support, and lower and upper spacers, 50, and, 52, respectively, provide spacing between disks 46. Solid portion, 54, of cylindrical vessel 12 is adapted to engage lower spacer 50 of the lowest radioactive disk 14 such that the group of radioactive sources 14 is approximately centered within spherical holder 16 when cylindrical vessel 12 is inserted therein, As will be described hereinbelow, the stack of radioactive wafer sources was wrapped with a thin tungsten foil (not shown in FIG. 2) before insertion into bore 13 of cylindrical vessel 12.

Figure 3:
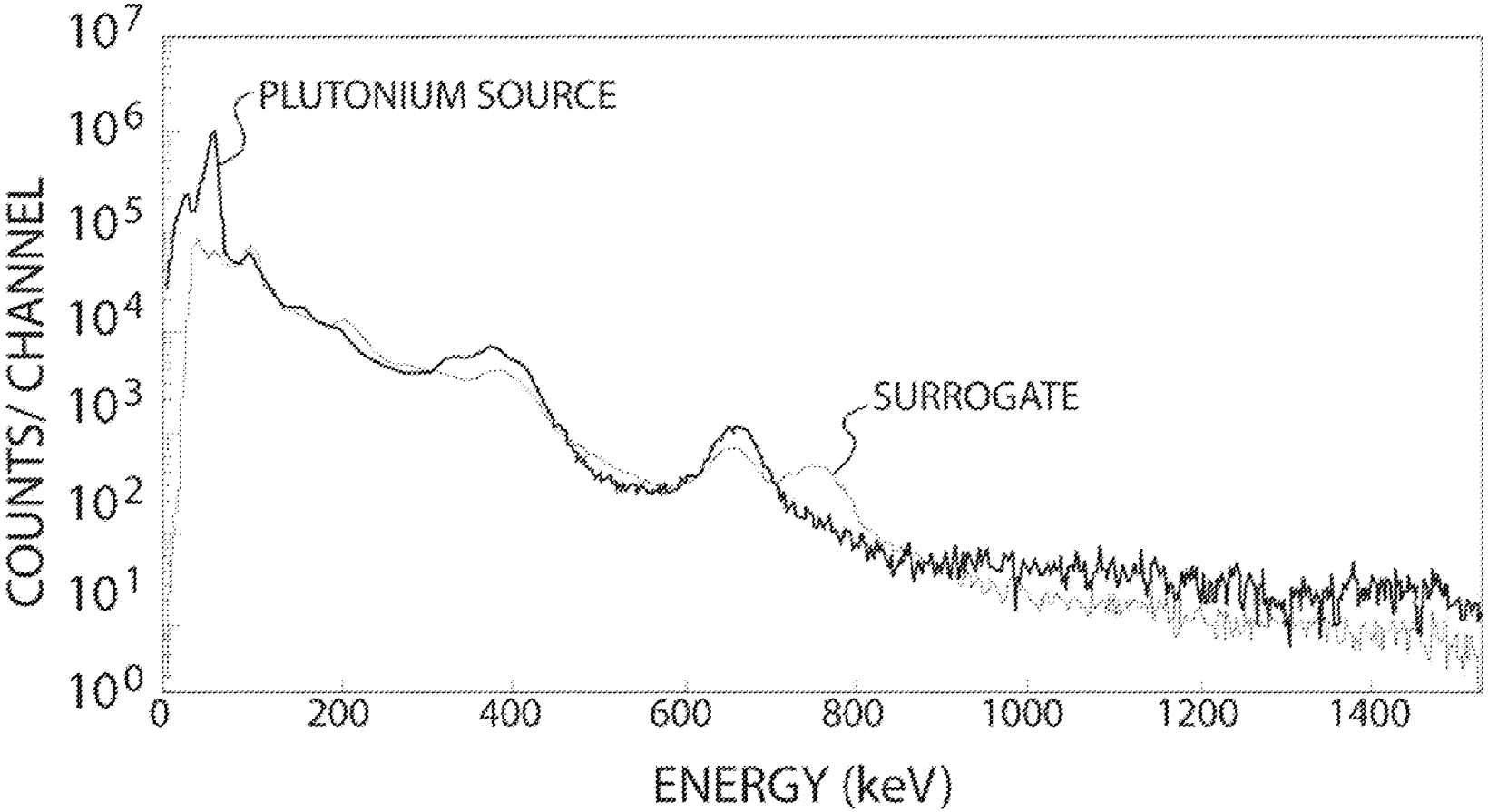
FIG. 3 shows a comparison gamma-ray spectrum of an embodiment of the surrogate radiation source of the present invention (thin line) as a function of the photon energy, compared with a plutonium spectrum (heavy line), both spectra being measured using a handheld sodium-iodide radioisotope identification device.

FIG. 3 shows a comparison gamma-ray spectrum of an embodiment of the surrogate radiation source of the present invention (thin line) as a function of the photon energy, compared with a plutonium spectrum (heavy line), both spectra being measured using a handheld sodium-iodide radioisotope identification device. Neutron fluxes appropriate for the gamma-radiation fluxes are provided by fission neutrons from the Cf-252 radioisotope.

Individual radioisotopes were commercially obtained from Isotope Products Laboratories as sealed, Type D Disks having similar geometries. Disks 46 having about a 1-in. diameter and a thickness of approximately 0.25 in, were stacked in 1.8-in. outer diameter×6-in. long transparent polycarbonate cylindrical vessel 12, using washers 48 and spacers 50 and 52 fabricated from 0.25-in. thick polycarbonate to adjust source spacing and to prevent the movement of the individual sources.

A spherical geometry was chosen for uniform attenuation of the gamma-ray spectrum (assuming that radioisotope sources are placed at the center of the sphere. Requirements for dose rate, radiation attenuation, weight, and transparency were satisfied by a sphere having radius of 4.25-in. composed of clear or transparent plastic (thermoset) resin. That is, this diameter provides the appropriate "stand-off" distance from the radioactive sources to the surface of the ball to achieve a contact dose rate below 5 mRem/h, and the spherical shape approximates the design of an isotropically shielded surrogate source. The transparent material allows visual confirmation of the presence of the sealed sources.

As an example, an inexpensive, clear, commercially available, off-the-shelf bowling ball 16 (the Lane Hawk "Clear Ball") was employed, since it provides the added benefits of the easy re-supply and replacement, and the wide availability of different types of hard and soft carrying cases. Further, the costs of annealing and machining are low, and a simple removable handle made from high-quality nylon webbing, and a rubber grip can be used to carry the surrogate. A 2-in. diameter, 6-in. long cylindrical radial bore 20 was machined into the sphere. As stated hereinabove, inner sleeve 12 and radioisotope sources 14 were placed in bore 20 and the bore sealed with a plastic cylinder plug 40 secured with shoulder bolts.

Different configurations of radioisotopes were examined for the surrogate. The four combinations shown in TABLES 1-4 were found to closely satisfy the requirements of a useful surrogate weapons-grade plutonium radiation source.

TABLE 1

Radioisotopic sources used for surrogate configuration 6.

| Isotope | Initial activity (μCi) | Half-life (days) | Activity when tested (μCi) |
|---|---|---|---|
| Ba-133 | 5.41 | 3836.15 | 5.36 |
| Cf-252 | 5.00 | 965.43 | 4.90 |
| Cs-137 | 5.21 | 10975.55 | 5.19 |
| Cs-137 | 5.18 | 10975.55 | 5.16 |
| Gd-153 | 515.40 | 240.40 | 508.02 |
| Lu-177m | 47.17 | 160.40 | 41.62 |
| Sn-113 | 21.24 | 115.09 | 15.07 |
| Sn-113 | 20.46 | 115.09 | 14.52 |
| Zr-95 | 10.26 | 64.02 | 5.54 |

TABLE 2

Radioisotopic sources used for surrogate configuration 8 including tungsten foil wrapping.

| Isotope | Initial activity (μCi) | Half-life (days) | Activity when tested (μCi) |
|---|---|---|---|
| Ba-133 | 5.41 | 3836.15 | 5.30 |
| Cf-252 | 5.00 | 965.43 | 4.68 |
| Cs-137 | 5.21 | 10975.55 | 5.17 |
| Cs-137 | 5.18 | 10975.55 | 5.14 |
| Gd-153 | 515.40 | 240.40 | 424.88 |
| Lu-177m | 47.17 | 160.40 | 31.84 |
| Sn-113 | 21.24 | 115.09 | 10.37 |
| Sn-113 | 20.46 | 115.09 | 9.99 |
| Zr-95 | 10.26 | 64.02 | 2.83 |

TABLE 3

Radioisotopic sources used for surrogate configuration 9 including tungsten foil wrapping.

| Isotope | Initial activity (μCi) | Half-life (days) | Activity when tested (μCi) |
|---|---|---|---|
| Ba-133 | 5.41 | 3836.15 | 5.24 |
| Cf-252 | 5.00 | 965.43 | 4.48 |
| Co-57 | 52.65 | 271.79 | 33.10 |
| Cs-137 | 5.21 | 10975.55 | 5.15 |
| Cs-137 | 5.18 | 10975.55 | 5.12 |
| Gd-153 | 515.40 | 240.40 | 354.32 |
| Lu-177m | 52.89 | 160.40 | 46.06 |
| Sn-113 | 21.24 | 115.09 | 7.10 |
| Sn-113 | 20.46 | 115.09 | 6.84 |
| Zr-95 | 10.26 | 64.02 | 1.43 |

TABLE 4

Radioisotopic sources used for surrogate configuration 10 including tungsten foil wrapping.

| Isotope | Initial activity (μCi) | Half-life (days) | Activity on Aug. 2, 2006 (μCi) |
|---|---|---|---|
| Ba-133 | 5.41 | 3836.15 | 5.24 |
| Cf-252 | 5.00 | 965.43 | 4.48 |
| Co-57 | 52.65 | 271.79 | 33.10 |
| Cs-137 | 5.21 | 10975.55 | 5.15 |
| Cs-137 | 5.18 | 10975.55 | 5.12 |
| Gd-153 | 515.40 | 240.40 | 354.32 |
| Lu-177m | 52.47 | 160.40 | 45.69 |
| Sn-113 | 21.24 | 115.09 | 7.10 |
| Sn-113 | 20.46 | 115.09 | 6.84 |
| Th-228 | 4.20 | 697.73 | 4.07 |
| Zr-95 | 10.26 | 64.02 | 1.43 |

A tungsten foil (0.05-mm thickness) was used to simulate the 59.5 gamma-rays from americium-241 (a daughter product due to the beta-decay of plutonium-241), since elemental tungsten emits 59.3-keV fluorescence x-rays if stimulated by higher energy photons. The use of foil reduces the self-attenuation of the fluorescence x-rays in the tungsten. In the present case, 80-keV gamma-rays emitted by the barium-133 source provide a means for inducing the x-ray fluorescence response.

It might be beneficial to consolidate some of the individual radioisotope sources into single sealed-source, based on similarity of half-lives. For example, Sn-113 might be combined with Lu-177m, and Gd-153 with Co-57. Based on their relatively long half-lives, Eu-155, Ba-133 and Cs-137 might be combined. Typically, Cf-252 is sealed in a different manner than gamma-beta sources, and may not be practically combined with the other isotopes.

Measurements were performed at a distance of 1 m for 55 s from the center of spherical source holder 16 of plutonium surrogate 10. Detectors were positioned in the "equatorial plane" of the spherical source holder, relative to the vertical axis of the source cylinder. In each set, 10 individual measurements were made with each radioisotope identification device (GR-135 and ThermoElectron IdentiFinder-U). The results are set forth in TABLE 5.

TABLE 5

Summary of radiation measurements for two surrogate configurations.

| | Configuration 6 | | Configuration 8 | |
|---|---|---|---|---|
| Detector | Identification | No. of occurrences (out of 10) | Identification | No. of occurrences (out of 10) |
| GR-135 | Pu-239 | 10 | Pu-239 | 7 |
| | Unknown | 10 | Unknown | 6 |
| IdentiFinder | Pu-239 | 10 | Pu-239 | 9 |
| | Ga-67 | 8 | Cs-137 | 9 |
| | | | Not in Library | 1 |

Plutonium was identified in the majority of the measurements (between 70 and 90%). Radiation measurements were made using surrogate configuration 6 which yielded indications of Pu-239 accompanied by an "unknown" on 10 consecutive measurements using the GR-135 detector. On the same day, measurements using the same surrogate but with the IdentiFinder detector yielded indications of plutonium on 10 consecutive measurements, eight of which were accompanied by indications of the presence of gallium-67. Two months later configuration 8 yielded three indications of Pu-239 only, four indications of plutonium-239 and "unknown" and two indications of "unknown" only using the and the GR-135 detector. On the same day, measurements of surrogate configuration 8 yielded nine instances of indication of plutonium-239 accompanied by cesium-137, and a single instance in which the IdentiFinder detector indicated "Not In Library."

As may be observed in FIG. 3, the surrogate spectrum also yielded a good visual approximation of the weapons-grade plutonium spectrum across relevant energies.

Measurements of the surrogate (configurations 6 and 8) were also performed using an adaptable radiation area monitor (ARAM) employing a 4-in.×4-in.×16-in. NaI, gamma-ray detector, He-3 tubes, and the autoGadRas isotope identification software. The surrogate was rolled past the ARAM at a distance of closest approach of about one meter, which consistently yielded an identification of plutonium for the surrogate.

Spectra from the surrogate for various configurations were also measured using an ORTEC Detective which employs high-purity germanium (HPGe). These measurements were intended to confirm the actual isotopic composition and activities of the surrogate. In configurations 8 and 9 which included the surrounding layer of tungsten foil to produce 59.3 photons, yielded an indication of plutonium-239 on the Detective after 2-3 min, of measurement time at a distance of about 30 cm.

The dose rate from the prototype has been modeled in full, three-dimensional geometry, including disc sources, plastic spacers and spherical resin sphere. At a radius of 30 cm from the center of the sphere, the dose rate is estimated at a conservative maximum value of 2.8 mRem/h which is below the desired limit of 5 mRem/h. Approximately one-third of the dose is imparted by neutrons. It is reasonable to estimate that the 30 cm standoff from the surface of the spherical container is equivalent to the dimensions of the shipping container that will be used with the prototype. Therefore, in order to affect a dose rate less than 0.5 mRem/h at the surface of a shipping container, the dose rate must be attenuated by a factor of one-sixth using shielding materials alone. This attenuation is approximately equivalent to two mean-free paths of any chosen shielding material (The upper limit on dose rate is determined by situating the particular source disks that contribute the most doses at the outside of the disk stack to minimize self-shielding.).

TABLE 6 shows a sample determination of whether a surrogate meets DOT Limited Quantity requirements.

TABLE 6

Typical spreadsheet entry to determine if configuration meets DOT Limited Quantity requirements.

| Isotope | A2 (Ci) | A2/1000 (Ci) | Proposed activity (mCi) | Fractional contribution to limit |
|---|---|---|---|---|
| Ba-133 | 81 | 0.081 | 0.00520491 | 6.426E−05 |
| Cf-252 | 0.081 | 0.000081 | 0.004278794 | 5.282E−02 |
| Co-57 | 270 | 0.27 | 0.030276376 | 1.121E−04 |
| Cs-137 | 16 | 0.016 | 0.005136143 | 3.210E−04 |
| Cs-137 | 16 | 0.016 | 0.005106551 | 3.192E−04 |
| Eu-155 | 81 | 0.081 | 0.282559516 | 3.48SE−03 |
| Gd-153 | 240 | 0.24 | 0.31548422 | 1.315E−03 |
| Lu-177m | 0.54 | 0.00054 | 0.019579549 | 3.626E−02 |
| Sn-113 | 54 | 0.054 | 0.005750276 | 1.065E−04 |
| Sn-113 | 54 | 0.054 | 0.005539108 | 1.026E−04 |
| Th-228 | 0.027 | 0.000027 | 0.004 | 1.481E−01 |
| Zr-95 | 22 | 0.022 | 0.000978542 | 4.44SE−05 |
| | | | 0.683893987 | 2.431E−01 |
| | | | Total mCi | Consignment A2 Fraction |

In general, alpha-emitting radioisotopes are assigned lower regulatory limits on activity. In TABLE 6, this is apparent in the large fraction of the consignment activity fraction attributable to Th-228, even though the activity of the thorium is relatively low when compared with other isotopes. The remainder of the consignment fraction is largely attributable to the high activities of Gd-153 and Eu-155. The total consignment A2 fraction is approximately 25% which indicates that the activity of the surrogate could be increased by a factor of up to four and still meet DOT Limited Quantity requirements.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A radiation surrogate for weapons-grade plutonium, comprising in combination the radioisotopes: Ba-133 having an activity of between 5 and 5.5 μCi, Cf-252 having an activity of between about 4 and about 5 μCi, Cs-137 having an activity of between about 10.2 and about 10.4 μCi, Gd-153 having an activity of between about 350 and about 550 μCi, Lu-177m having an activity between about 40 and about 50 μCi, Sn-113 having an activity between about 13.5 and about 30 μCi, and Zr-95 having an activity between about 1 and about 6 μCi; wherein said combination of radioisotopes is substantially surrounded by tungsten foil.

2. The radiation surrogate of claim 1, wherein said radioisotopes in said combination of radioisotopes are individually sealed.

3. The radiation surrogate of claim 2, wherein said individually sealed radioisotopes in said combination of radioisotopes are disk-shaped.

4. The radiation surrogate of claim 3, further comprising a cylindrical polycarbonate holder for holding said disk-shaped radioisotopes in said combination of radioisotopes in a stacked configuration.

5. The radiation surrogate of claim 4 wherein said combination of radioisotopes is disclosed in a thermoset resin container.

6. The radiation surrogate of claim 5, wherein said resin container is a clear plastic container.

7. The radiation surrogate of claim 6, wherein said resin container is a spherical container.

8. The radiation surrogate of claim 1, wherein said combination of radioisotopes further comprises at least one radioisotope selected from the group consisting of Co-57 having an activity of about 33 μCi, and Th-228 having an activity of about 4 μCi.

9. The radiation surrogate of claim 8, wherein said combination of radioisotopes is substantially surrounded by tungsten foil.

10. The radiation surrogate of claim 8, wherein said radioisotopes in said combination of radioisotopes are individually sealed.

11. The radiation surrogate of claim 10, wherein said individually sealed radioisotopes in said combination of radioisotopes are disk-shaped.

12. The radiation surrogate of claim 11, further comprising a cylindrical polycarbonate holder for holding said disk-shaped radioisotopes in said combination of radioisotopes in a stacked configuration.

13. The radiation surrogate of claim 11 wherein said combination of radioisotopes is disposed in a thermoset resin container.

14. The radiation surrogate of claim 13, wherein said resin container is a clear plastic container.

15. The radiation surrogate of claim 14, wherein said resin container is a spherical container.

* * * * *